US011142434B1

(12) United States Patent
Zhou et al.

(10) Patent No.: US 11,142,434 B1
(45) Date of Patent: Oct. 12, 2021

(54) APPARATUS AND METHODS FOR SENSING BOOM SIDE DEFLECTION OR TWIST

(71) Applicant: LINK-BELT CRANES, L.P., LLLP, Lexington, KY (US)

(72) Inventors: Peter Zhou, Lexington, KY (US); Don E. Moore, Lexington, KY (US); Gene Martin, Richmond, KY (US)

(73) Assignee: LINK-BELT CRANES, L.P., LLLP, Lexington, KY (US)

( * ) Notice: Subject to any disclaimer, the term of this patent is extended or adjusted under 35 U.S.C. 154(b) by 1652 days.

(21) Appl. No.: 14/623,960

(22) Filed: Feb. 17, 2015

Related U.S. Application Data

(60) Provisional application No. 61/941,089, filed on Feb. 18, 2014.

(51) Int. Cl.
*B66C 13/16* (2006.01)
*B66C 15/06* (2006.01)

(52) U.S. Cl.
CPC ..... *B66C 13/16* (2013.01); *B66C 15/06* (2013.01)

(58) Field of Classification Search
CPC ..... B66C 13/16; B66C 15/06; B66C 23/90; B66C 13/06; B66C 23/84; G01B 2210/58
USPC ..... 702/34; 703/7; 700/97; 73/862.06
See application file for complete search history.

(56) References Cited

U.S. PATENT DOCUMENTS 3,338,091 A 8/1967 Tatum
3,724,559 A * 4/1973 Stromnes ..... E21B 7/022 173/193
3,952,879 A * 4/1976 Grove ..... B66F 17/006 212/278
4,752,012 A * 6/1988 Juergens ..... B66C 23/905 212/277
5,160,056 A 11/1992 Yoshimatsu et al.
5,217,126 A 6/1993 Hayashi et al.
5,251,768 A 10/1993 Yoshimatsu et al.
6,735,486 B2 5/2004 Hoffelmeyer et al.
8,272,521 B1 9/2012 Kemmerly et al.
2003/0173324 A1* 9/2003 Puszkiewicz ..... B66C 23/90 212/277
2003/0214415 A1* 11/2003 Shaw ..... B66C 13/44 340/685
2004/0000530 A1* 1/2004 Yahiaoui ..... B66C 23/905 212/278
2008/0044236 A1* 2/2008 Lloyd ..... E02D 7/16 405/232
2009/0261053 A1* 10/2009 Bohnacker ..... B66C 23/60 212/300

(Continued)

*Primary Examiner* — Dzung Tran
(74) *Attorney, Agent, or Firm* — Dickinson Wright PLLC; Andrew D. Dorisio

(57) ABSTRACT

A crane includes a boom adapted for lifting a load and a sensor adapted for measuring the side deflection or twist of the boom during the lifting of the load. The crane may also include a system for detecting side deflection in the boom using a first sensor mounted to the boom for sensing a first value corresponding to deflection of the boom, a second sensor for sensing a second, reference value, and a controller for comparing the first and second values to determine a deflection amount. An operator may be notified if the side deflection or twist values exceed a predetermined value. Side deflection or twist values for the boom during a lifting operation may also be logged by a data recording device for later use.

18 Claims, 3 Drawing Sheets

(56) References Cited

U.S. PATENT DOCUMENTS

| | | | | |
|---|---|---|---|---|
| 2012/0211301 | A1* | 8/2012 | Clark | B66F 17/006 182/2.2 |
| 2012/0265411 | A1* | 10/2012 | Deng | B66C 23/823 701/50 |
| 2014/0014609 | A1 | 1/2014 | Stakor et al. | |
| 2014/0165692 | A1* | 6/2014 | Rannow | F15B 19/002 73/1.63 |
| 2014/0299564 | A1* | 10/2014 | Lin | B66C 13/085 212/273 |
| 2015/0112638 | A1* | 4/2015 | Morrow | B66C 13/46 702/182 |

* cited by examiner

APPARATUS AND METHODS FOR SENSING BOOM SIDE DEFLECTION OR TWIST

This application claims the benefit of U.S. Provisional Patent Application Ser. No. 61/941,089, the disclosure of which is incorporated herein by reference.

TECHNICAL FIELD

This disclosure pertains to the lifting arts and, more particularly, to an apparatus and methods for sensing boom side deflection or twist.

BACKGROUND

A crane boom is designed primarily to lift loads in the vertical direction. The vertical direction is sometimes referred to as "in-plane" direction, which corresponds to an imaginary plane formed by the boom and the vertical load hoist line connected to it. On the other hand, cranes could experience secondary loadings in the horizontal direction, which is often called "out-of-plane" or side direction perpendicular to the "in-plane". The secondary loading on the boom structures, or side loading, may be introduced by slewing/braking, wind, the crane being out of level, an off lead of hoist line, and side pulls. The side loading may then deform the boom and produce additional stresses on it.

Crane manufacturers design the boom to withstand certain amount of side load according to specific applications and relevant design codes (e.g., SAE (Society of Automotive Engineers), ISO (International Organization for Standardization, etc.). However, the actual side deflection of the boom may exceed the allowed deflections for which the crane is designed and tested while lifting a load due to elevated side loading. Consequently, cranes may be in an unacceptable state due to excessive side deflections. Therefore, it is desirable to detect and monitor the boom side deflections in real time to prevent unexpected failure of the boom structures.

In practice, the data acquisition process for boom deflections often involves line of sight observations and data post processing by human beings. Direct measurement methods of deflection may be utilized by manufacturers during the structural integrity verification tests of prototypes. However, these methods are not suitable for real time, unattended measurement due to the above-mentioned shortcomings.

Accordingly, a need is identified for an apparatus and methods for sensing boom side deflections and twisting.

SUMMARY

According to one aspect of the disclosure a crane comprises a boom adapted for lifting a load and means, such as a sensor, for sensing or measuring the side deflection or twist of the boom. The sensor may comprise an inclinometer, such as a single axis inclinometer or a dual axis inclinometer. The sensor may be mounted on a side of the boom, and may be mounted adjacent to a head of the boom.

The sensor may generate an output signal corresponding to an amount of side deflection or twist. A controller may be provided for processing the output signal into a user-perceptible form, such as a numerical display of side deflection or twist. The user-perceptible form may also comprise a visual or audible warning indicating that a predetermined level of side deflection or twist has been exceeded.

A second sensor may also be provided for establishing a reference value for purposes of comparing the output signal of the first sensor. A controller may be provided for comparing an output of the sensor with the reference value to determine the side deflection or twist of the boom. The second sensor may be mounted to a base of the boom.

A further aspect of the disclosure pertains to a system for detecting side deflection in a boom mounted to a crane. The system comprises a first sensor mounted to the boom for sensing a first value corresponding to deflection of the boom, a second sensor for sensing a second, reference value, and a controller for comparing the first and second values. The controller may be adapted to determine a deflection amount for the crane boom. The second sensor may be mounted to the crane upper, in which case the second, reference value corresponds to a list of the crane. The second sensor may be mounted to a base on the boom and the first sensor mounted adjacent to a head of the boom (which in all cases may be telescopic).

Also disclosed is a method of manufacturing a crane. The method comprises providing a sensor for sensing side deflection or twist on a boom of the crane. The providing step may include mounting the sensor on a lateral side face of the boom adjacent to a head end thereof. The method may further include the step of logging side deflection or twist values during the lifting of a load by the crane.

Yet another aspect of the disclosure relates to a method of detecting a boom condition in a crane. The method comprises determining a first value corresponding to the deflection or twist of the boom, and providing the first value to a controller for determining the deflection or twist of the boom. The providing step may comprise comparing the first value to a second, reference value.

A further but related aspect of the disclosure relates to a method for use in evaluating a possible cause of a failure of a crane or boom. The method comprises storing, in a data recording device, one or more side deflection or twist values for the boom during a lifting operation. The method may further include the step of displaying one or more of the side deflection or twist values during a lifting operation. The step of determining the one or more side deflection values may be completed by: (1) determining a first value corresponding to the side deflection or twist of the boom using a first sensor mounted to the boom; and (2) providing the first value to a controller for determining the side deflection or twist of the boom by comparing the first value to a second, reference value provided by a second sensor associated with the crane.

BRIEF DESCRIPTION OF THE DRAWINGS

The accompanying drawings incorporated in and forming a part of the specification illustrate several aspects of the invention and, together with the description, serve to explain the principles of the disclosed embodiments of the invention.

In the drawings.

DETAILED DESCRIPTION

Figure 1:
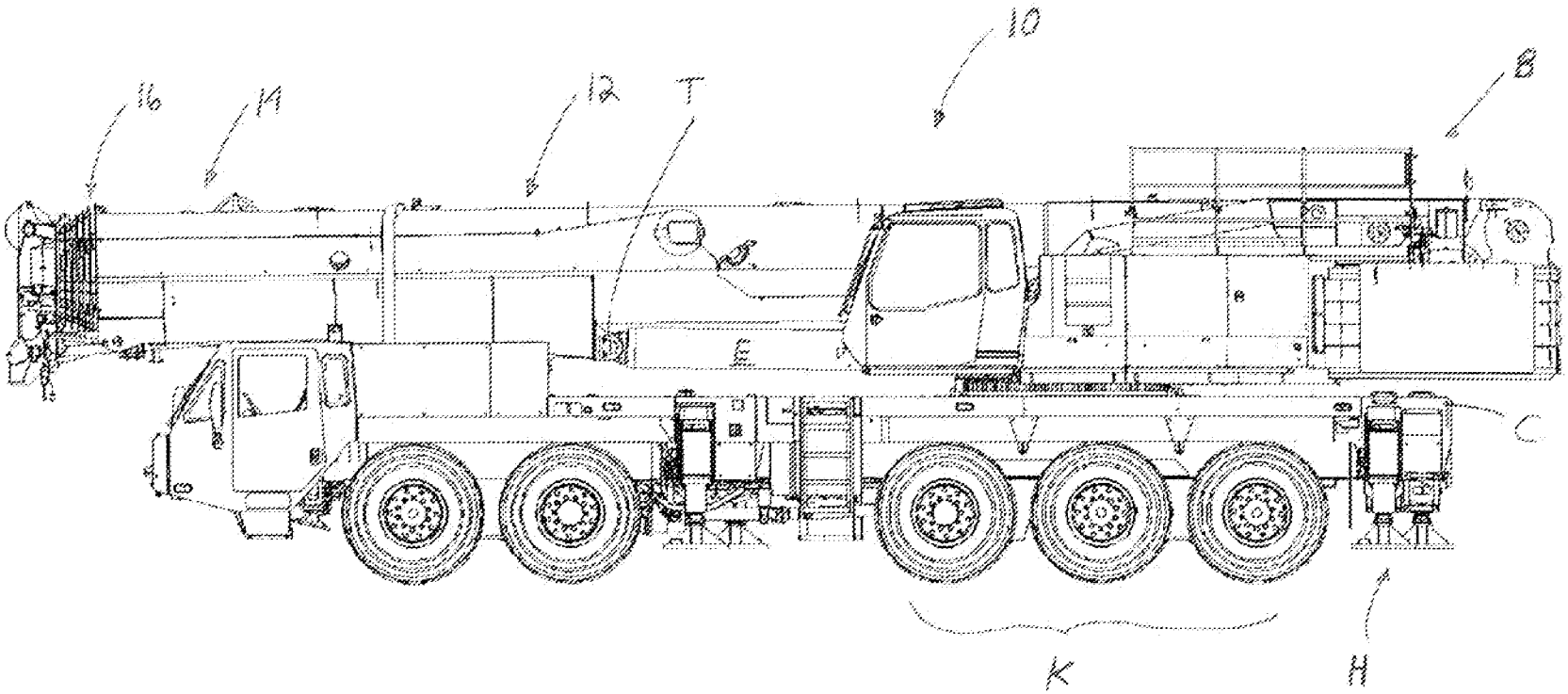
FIG. 1 is a side view of an exemplary vehicle, such as a crane, to which aspects of the present disclosure may be applied.

Reference is now made to FIG. 1, which provides an overall perspective view of a crane 10 for which the inventions described herein may have utility. In the embodiment illustrated in FIG. 1, this crane 10 includes a telescoping boom 12 having at least two generally tubular boom sections 14, 16. The first or outer base boom section 14 is pivotally mounted on a bodily rotatable base B (also known as the crane "upper") supported by a chassis C having ground-engaging structures (e.g., wheels K or crawler tracks, if mobile, and outriggers H). The second boom section 14 is telescopically received within the first or base boom section 14. It should be appreciated that additional boom sections may be telescopically received within the second boom section 14 and so on. An internal hydraulic cylinder (not shown) is provided to move the telescoping boom sections 14, 16 relative to each other in a manner known in the art, and a lifter E, such as an external cylinder, connects with the boom 12 at a connection point T, and can be used to pivot it in a vertical direction in a selective fashion to lift loads.

Figure 2:
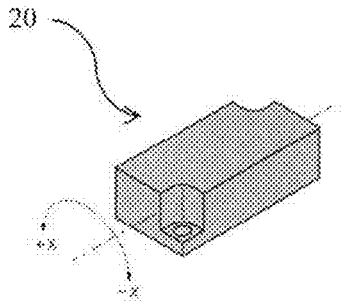
FIGS. 2 and 3 illustrate sensors for possible use in connection with the crane boom for determining side deflection or twist.
Figure 3:
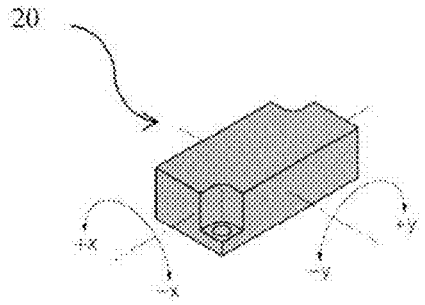
Figure 4:
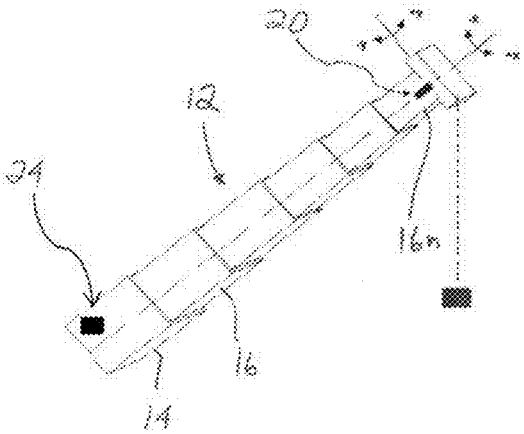
FIG. 4 is a schematic view showing the positioning of the sensors along the boom.

With reference to FIGS. 2-4, the deflections of the boom 12 may be understood as the change of coordinates in X, Y, and Z directions at any given point on the boom when the boom is deformed from its initial state by lifting a load L (FIG. 4). To differentiate the deflections in different directions, i.e., "in-plane", "out-of-plane", etc., they may be assigned different names. Deflections in the "in-plane" deflections are known as vertical deflections. Side deflections are defined as that in "out-of plane" direction. Twist of the boom, on the other hand, is rotation about the axis of the boom 12.

According to the disclosure, the direct measurement of the boom deflections in both vertical and side directions may be achieved using a sensor 20. As shown in FIG. 4, this sensor 20 may be mounted on the boom 12 or remotely installed away from the crane 10, and may comprise an inclinometer. The inclinometer serving as sensor 20 may have a single axis (FIG. 2) or a dual axis (FIG. 3) capability, which may be used for measuring angles in one or two directions, respectively. The sensor 20 may be located anywhere on the crane 10 where the tilt angles of the boom 12 are to be measured, such as at the boom base 14 or anywhere along the boom itself (e.g., the upper most or head section, 16*n* in FIG. 4. The direction of the sensor 20 being mounted on the crane 10 is determined based upon the intended direction of the angles.

In order to measure the boom twist and the angle at the boom top, a dual axis inclinometer may be mounted on or adjacent to the boom top (that is, adjacent to the head of the boom, such as along section 16*n*) in such way that its x-axis is parallel to boom axis and y-axis perpendicular to boom axis "in-plane," as indicated in FIG. 4. The signals generated by the sensor 20 may then be transmitted to a controller 22, such as electronic control module (ECM) installed on the crane upper or base B. The transmission may be done wirelessly or through an electric cable for further data processing or displaying, such as on a display in the cab forming part of the base B.

While a dual axis sensor 20 may be preferable for some applications, one or more single axis sensors may be used in lieu of the dual axis sensor. In cases where the boom 12 includes an attachment, such as a fly section or jib, it is also possible to mount a sensor 20 thereon (either single axis or dual axis), which is considered part of the boom for purposes of this disclosure.

Figure 6:
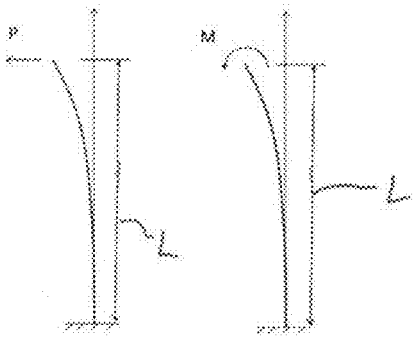
FIG. 6 illustrates schematically the variables used in determining boom side deflection and twist.
Figure 5:
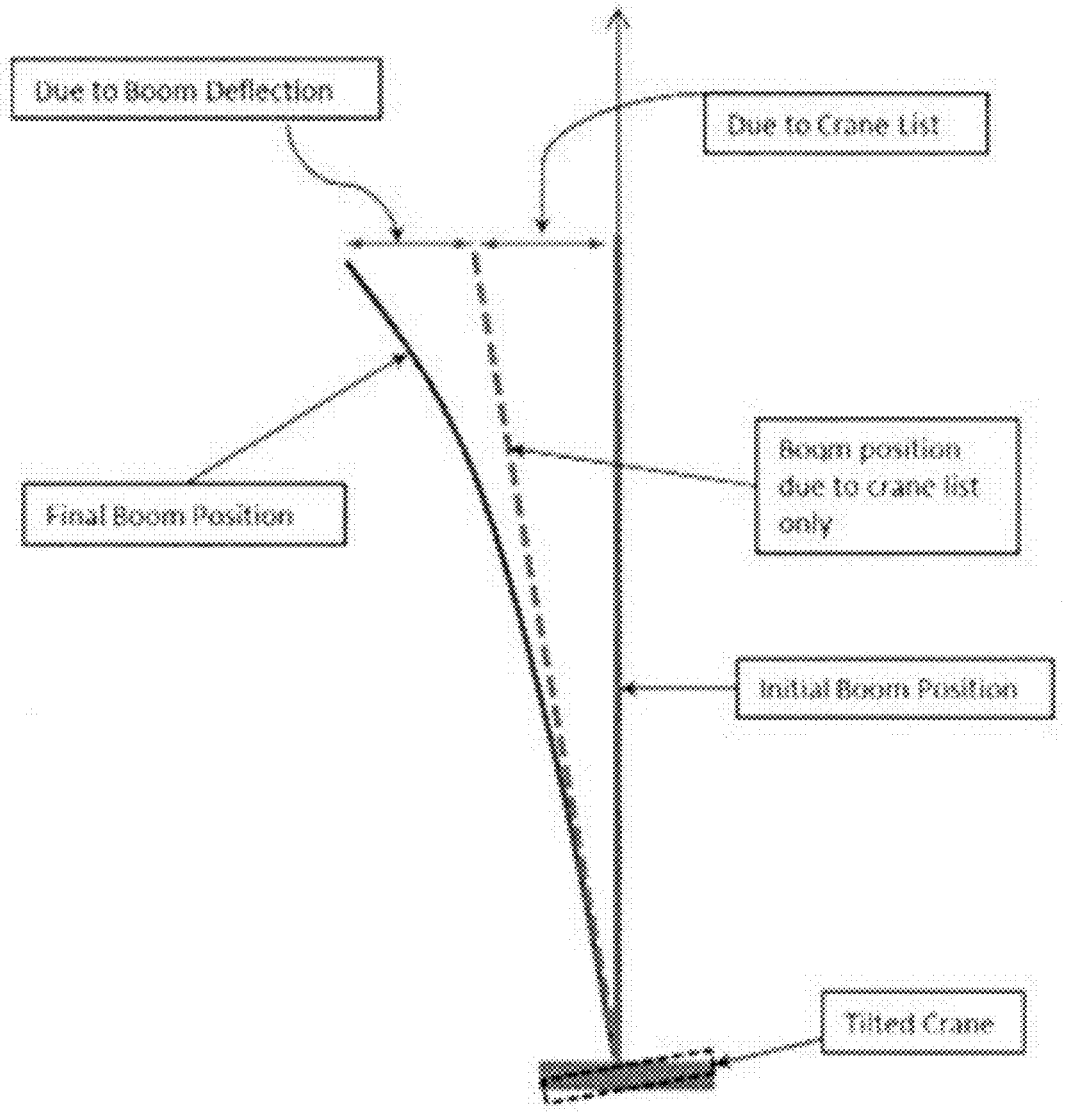
FIG. 5 is a schematic view illustrating the issue of crane tilt.

In terms of determining the measured values, the side angle at the boom top indicates the combined total movement by boom deflection itself and crane list (sideways) as illustrated in FIG. 5. The total deflections of the boom 12 at the top can be described as:

$$DEF_{Total}=DEF_{Boom}+DEF_{crane} \tag{1}$$

Where $DEF_{Total}$ is the total deflection of the boom $DEF_{Boom}$ is the deflection due to the boom deformation only $DEF_{crane}$ is the deflection due to the list of the crane side ways The deflection due to crane list $DEF_{crane}$ can be determined if the list angle is known:

$$DEF_{crane}=L\ \mathrm{Sin}(\alpha)\tan(\mathrm{LIST}) \tag{2}$$

Where L is the length of boom (FIG. 6)

$\alpha$ is the boom angle between the boom axis and horizontal;

LIST is the list angle of the crane 10 measured by a second sensor 24 (for example, an inclinometer mounted on the crane 10, such as to the upper or base B). However, the second sensor 24 may be mounted on a different part of the boom 12 from the first sensor 20, such as the base section 14 of the boom 12, as shown in FIG. 4.

In order to determine the net deflection of the deformed boom $DEF_{Boom}$, it is an option to use beam deflection theory and the measured side angles at the boom top. The boom 12 can be simplified as a cantilever beam under a concentrated load P and/or a moment M at the end (FIG. 6). The effect of the boom weight can be included by applying an equivalent concentrated load.

The combined deflection with both concentrated load P and moment M can be derived as a function of the side angle (in radians):

$$DEF_{Boom}=\frac{\left[\frac{PL}{3}+\frac{M}{2}\right]}{\left[\frac{PL}{2}+M\right]}L(\theta-\mathrm{LIST}\ \sin\alpha) \tag{3}$$

where $\theta$ is the side angle in radian measured by the inclinometer.

"Effective" length can be introduced herein such that $$M=Pl_e \tag{4}$$

Therefore, equation (3) can be written as:

$$DEF_{Boom}=\frac{2}{3}L(\theta-\mathrm{LIST}\ \sin\alpha)\left[\frac{2+3\frac{l_e}{L}}{2+4\frac{l_e}{L}}\right] \tag{5}$$

where $l_e$ is the effective length produced by the moment M applied on the boom top. For a boom without fly or jib, $l_e$ is zero.

The net twist of boom is $$\mathrm{TWIST}_{Boom}=\mathrm{TWIST}_{Angle}-\mathrm{LIST}\ \cos\alpha \tag{6}$$

where $\mathrm{TWIST}_{Angle}$ is the inclinometer reading in x-axis, i.e., twist angle.

Equations (1), (2), (5), and (6) may be used to determine both side deflections and twist of the boom 12.

Example #1

| Example #1 | | Boom Deflection $DEF_{Boom}$ (eq. 5) | Crane Deflection $DEF_{Crane}$ (eq. 2) | Total Deflection $DEF_{Total}$ (eq. 1) |
|---|---|---|---|---|
| Boom Length L = | 150 ft; | 3.08 ft | 4.53 ft | 7.62 ft |
| Boom angle $\alpha$ = | 60 deg; | | | |
| Crane List angle | 2 deg | | | |
| LIST = | (0.0349 rad) | | | |
| Measured Side | 3.5 deg | | | |
| Angle $\theta$ = | (0.0611 rad) | | | |
| Effective Length le = | 0 ft | | | |

Example #2

| Example #2 | | Boom Twist $TWIST_{Boom}$ (eq. 6) |
|---|---|---|
| Boom Length L = | 100 ft | 1.70 deg |
| Boom angle $\alpha$ = | 40 deg | |
| List angle LIST = | 3 deg | |
| Measured Twist Angle $\theta$ = | 4 deg | |

Figure 7:
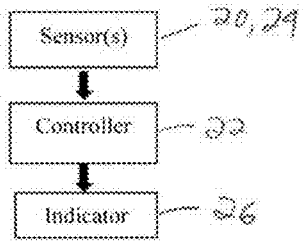
FIG. 7 is a schematic view illustrating the interaction between the sensor(s), the controller, and a warning device.

In summary, the disclosure proposes an easy and simple way to measure and calculate the side deflections and twist of a boom. This may allow the crane rated capacity limiter (RCL) or other onboard controller to efficiently process the raw signal readings for side and twist angles in real time. It is then possible for a crane manufacturer to introduce allowable values in the RCL system to limit the crane function and/or alert the crane operator when excessive side deflections are approaching (such as by giving an audible or visual warning; note indicator 26 in FIG. 7, which may comprise a display, speaker, or the like) or exceeded (the same, or possibly by creating a lock-out condition).

Inclinometer raw angle signals, boom side deflection, and twist may also be logged, such as to a data recording device (e.g., a memory) associated with the crane 10 or otherwise, for further analysis and investigations. For example, when there has been a boom failure, the operator may often be unsure as to the conditions that led to the failure. Logging of the side deflection values will provide a record of the condition prior to the failure and, thus, demonstrate whether the reason was excessive side deflection.

The foregoing descriptions of various embodiments provide illustration of the inventive concepts. The descriptions are not intended to be exhaustive or to limit the disclosed invention to the precise form disclosed. Modifications or variations are also possible in light of the above teachings. The embodiments described above were chosen to provide the best application to thereby enable one of ordinary skill in the art to utilize the inventions in various embodiments and with various modifications as are suited to the particular use contemplated. All such modifications and variations are within the scope of the invention as determined by the appended claims when interpreted in accordance with the breadth to which they are fairly, legally and equitably entitled.

The invention claimed is:

1. A crane, comprising:

a boom adapted for lifting a load; and a sensor adapted for sensing the side deflection or twist of the boom.

2. The crane of claim 1, wherein the sensor comprises an inclinometer.

3. The crane of claim 2, wherein the inclinometer comprises a single axis inclinometer.

4. The crane of claim 2, wherein the inclinometer comprises a dual axis inclinometer.

5. The crane of claim 1, wherein the sensor is mounted on a side of the boom.

6. The crane of claim 1, wherein the sensor is mounted adjacent to a head of the boom.

7. The crane of claim 1, wherein the sensor generates an output signal indicative of side deflection or twist, and further including a controller for processing the output signal into a user-perceptible form.

8. The crane of claim 7, wherein the user-perceptible form comprises a numerical display of side deflection or twist.

9. The crane of claim 7, wherein the user-perceptible form comprises a visual warning indicating that a predetermined level of side deflection or twist has been exceeded.

10. The crane of claim 7, wherein the user-perceptible form comprises an audible warning indicating that a predetermined level of side deflection or twist has been exceeded.

11. The crane of claim 7, further including a second sensor for providing a reference value, and a controller for comparing an output of the sensor with the reference value to determine the side deflection or twist of the boom.

12. The crane of claim 11, wherein the second sensor is mounted to a base of the boom.

13. A method of manufacturing a crane, comprising:

providing a sensor for sensing side deflection or twist on a boom of the crane.

14. The method of claim 13, wherein the providing step comprises mounting the sensor on a lateral side face of the boom adjacent to a head end thereof.

15. The method of claim 13, further including the step of logging side deflection values to a data recording device associated with the crane during the lifting of a load by the crane.

16. A crane, comprising:

a boom for lifting a load; and means for sensing the side deflection or twist of the boom.

17. The crane of claim 16, wherein the means for sensing comprises an inclinometer.

18. The crane of claim 16, further including means for indicating that a predetermined level of side deflection or twist has been exceeded.

* * * * *